US011443587B2

(12) United States Patent
Yamaguchi et al.

(10) Patent No.: US 11,443,587 B2
(45) Date of Patent: Sep. 13, 2022

(54) GAMING TABLE APPARATUS

(71) Applicant: Universal Entertainment Corporation, Tokyo (JP)

(72) Inventors: Shinsuke Yamaguchi, Tokyo (JP); Kouichi Matsumoto, Tokyo (JP); Yoshiyuki Kanno, Tokyo (JP); Masaya Kato, Tokyo (JP); Hideaki Imura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 16/507,837

(22) Filed: Jul. 10, 2019

(65) Prior Publication Data

US 2020/0020193 A1 Jan. 16, 2020

(30) Foreign Application Priority Data

Jul. 13, 2018 (JP) ..... 2018-133217

(51) Int. Cl.
*G07F 17/32* (2006.01)

(52) U.S. Cl.
CPC ..... *G07F 17/322* (2013.01); *G07F 17/3211* (2013.01); *G07F 17/3244* (2013.01); *G07F 17/3276* (2013.01); *G07F 17/3293* (2013.01); *G07F 17/3209* (2013.01)

(58) Field of Classification Search
CPC ..... G07F 7/04; G07F 17/322; G07F 17/3211; G07F 17/3244; G07F 17/3276; G07F 17/3293; G07F 17/3209; G07F 17/323
See application file for complete search history.

(56) References Cited

U.S. PATENT DOCUMENTS

2004/0219982 A1* 11/2004 Khoo ..... G07F 17/32 463/42
2005/0085287 A1* 4/2005 Sines ..... A63F 3/00157 463/13
2006/0073885 A1* 4/2006 Rowe ..... G07F 17/32 463/26

(Continued)

FOREIGN PATENT DOCUMENTS

JP 2016-116544 6/2016

*Primary Examiner* — James S. McClellan
*Assistant Examiner* — Ross A Williams
(74) *Attorney, Agent, or Firm* — Simpson & Simpson, PLLC; S. Peter Konzel

(57) ABSTRACT

To provide a gaming table apparatus capable of suppressing the prevention of progress of a game. The gaming table apparatus includes bet units on which gaming media betted by players are placed, a reading unit reading monetary values of the gaming media placed on the bet units, a card shoe in which cards used for a game are accommodated in a drawable manner, a detecting device detecting identification information of the cards taken from the card shoe and outputs the detected identification information, a controller managing the destination to which the game proceeds, a display displaying information about the destination to which the game proceeds managed by the controller, and a memory in which the information displayed on the display is stored, in which the controller determines the destination to which the game proceeds when the monetary values of the gaming medium betted on the bet unit change.

16 Claims, 11 Drawing Sheets

(56) References Cited

U.S. PATENT DOCUMENTS

| | | | | |
|---|---|---|---|---|
| 2007/0117604 | A1* | 5/2007 | Hill | G07F 17/32 463/16 |
| 2015/0054220 | A1* | 2/2015 | Brown | G07F 17/322 273/292 |
| 2015/0087371 | A1* | 3/2015 | Hill | G06F 17/3293 |
| 2016/0180634 | A1* | 6/2016 | Montgomery | G07F 17/3244 463/25 |

* cited by examiner

GAMING TABLE APPARATUS

CROSS-REFERENCE TO RELATED APPLICATION

This application claims the benefit of Japanese Patent Application No. 2018-133217, filed on Jul. 13, 2018, which application is incorporated herein by reference in its entirety.

FIELD OF THE INVENTION

The present invention relates generally to a gaming table apparatus that is installed in gaming facilities such as a casino and has a controller that manages various types of games.

BACKGROUND OF THE INVENTION

Conventionally, for example, in gaming facilities such as a casino, various types of games such as baccarat and Casino War are played using physical cards such as playing cards on a gaming table. Generally, a dealer is deployed for each game table on which one or more players play games. The dealer manages the progress of a game such as the distribution of cards taken from a card shoe to players, the betting of game chips having monetary values from players, the collection of game chips from players, the payout of game chips to players, and the like (see JP-A-2016-116544).

BRIEF SUMMARY OF THE INVENTION

However, for example, in a game that allows a player to select the subsequent destination to which the game proceeds by increasing or reducing the game chips having been betted while the game is played, when the player increases or reduces the game chips having been betted, it is necessary to wait for the player or the dealer to perform predetermined operation inputs to determine whether the increasing or reducing of the game chips represents an intention of the player for selecting the destination to which the game proceeds, thereby preventing smooth progress of the game.

The invention addresses the above problem with an object of providing a gaming table apparatus capable of suppressing the prevention of smooth progress of a game.

According to the invention, there is provided a gaming table apparatus including a plurality of bet units on which gaming media betted by a plurality of players are placed; a reading unit that reads monetary values of the gaming media placed on the bet units; a card shoe in which cards used for a game are accommodated in a drawable manner; a detecting device that detects identification information of the cards taken from the card shoe and outputs the identification information; a controller that manages a destination to which the game proceeds; a display that displays information about the destination to which the game proceeds, the information being managed by the controller; and a memory in which the information displayed on the display is stored, in which the controller is programmed to perform first processing that determines the destination to which the game proceeds for each of the players based on the identification information detected by the detecting device and the monetary values read by the reading unit, second processing that determines the destination to which the game proceeds for each of the players when the monetary values read by the reading unit make change, and third processing that reads the information about the determined destination to which the game proceeds from the memory and displays the read information on the display.

In this structure, since the destination to which the game proceeds is determined according to the change of the monetary value of the betted gaming medium and the determined destination is displayed on the display, the destination to which the game proceeds according to the change of the monetary value of the betted gaming medium can be easily determined and the game can be progressed smoothly.

In addition, in the structure of the gaming table apparatus according to the invention, the third processing includes processing that changes a display color of the information displayed on the display according to the destination to which the game proceeds, the display color being assigned for each of the players.

In this structure, since the display color of the display assigned for each of the players can be changed according to the destination to which the game proceeds, the destination to which the game proceeds can be easily grasped for each of the players.

In addition, in the structure of the gaming table apparatus according to the invention, the third processing includes processing that reads character information about the destination to which the game proceeds from the memory according to the change of the monetary values of the gaming media betted on the bet unit and displays the read character information on the display.

In this structure, the destination to which the game proceeds for each of the players can be easily grasped by displaying the destination to which the game proceeds for each of the players as the character information on the display according to the destination to which the game proceeds.

According to the invention, it is possible to provide a gaming table apparatus capable of suppressing the prevention of smooth progress of a game.

BRIEF DESCRIPTION OF THE DRAWINGS

The nature and mode of operation of the present invention will now be more fully described in the following detailed description of the invention taken with the accompanying drawing figures, in which.

and

Figure 11A:
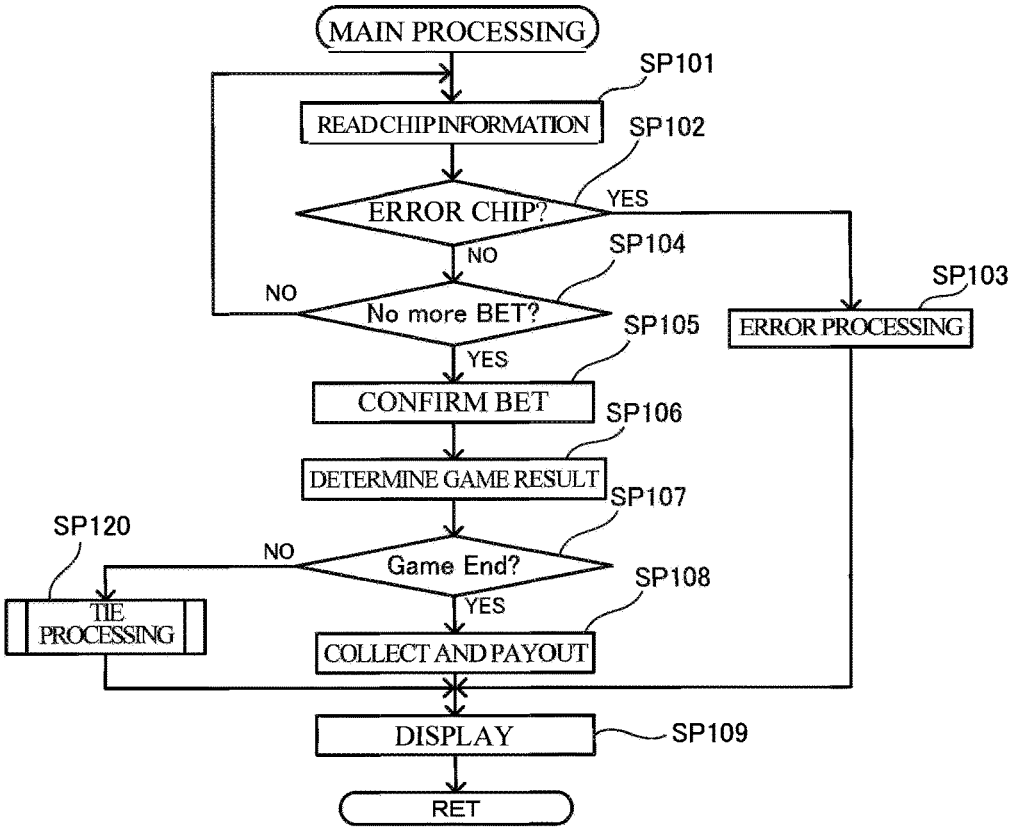
Figure 11B:
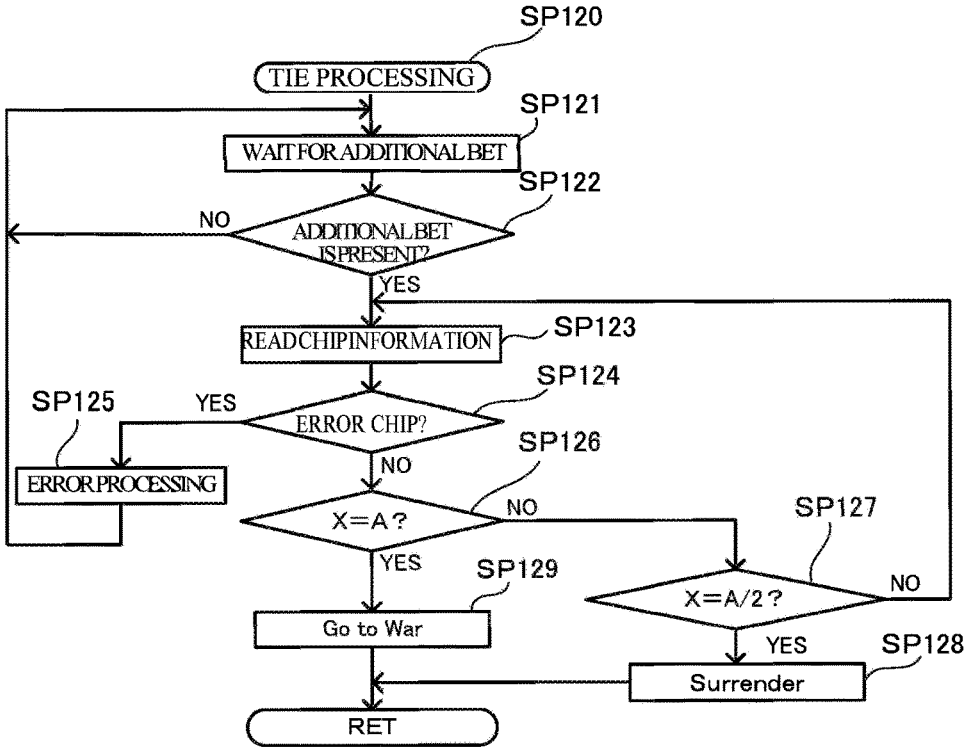

FIGS. 11A and 11B are flowcharts illustrating main processing and Tie processing.

DETAILED DESCRIPTION OF THE PREFERRED EMBODIMENT (Structure of Gaming Table Apparatus)

Figure 1:
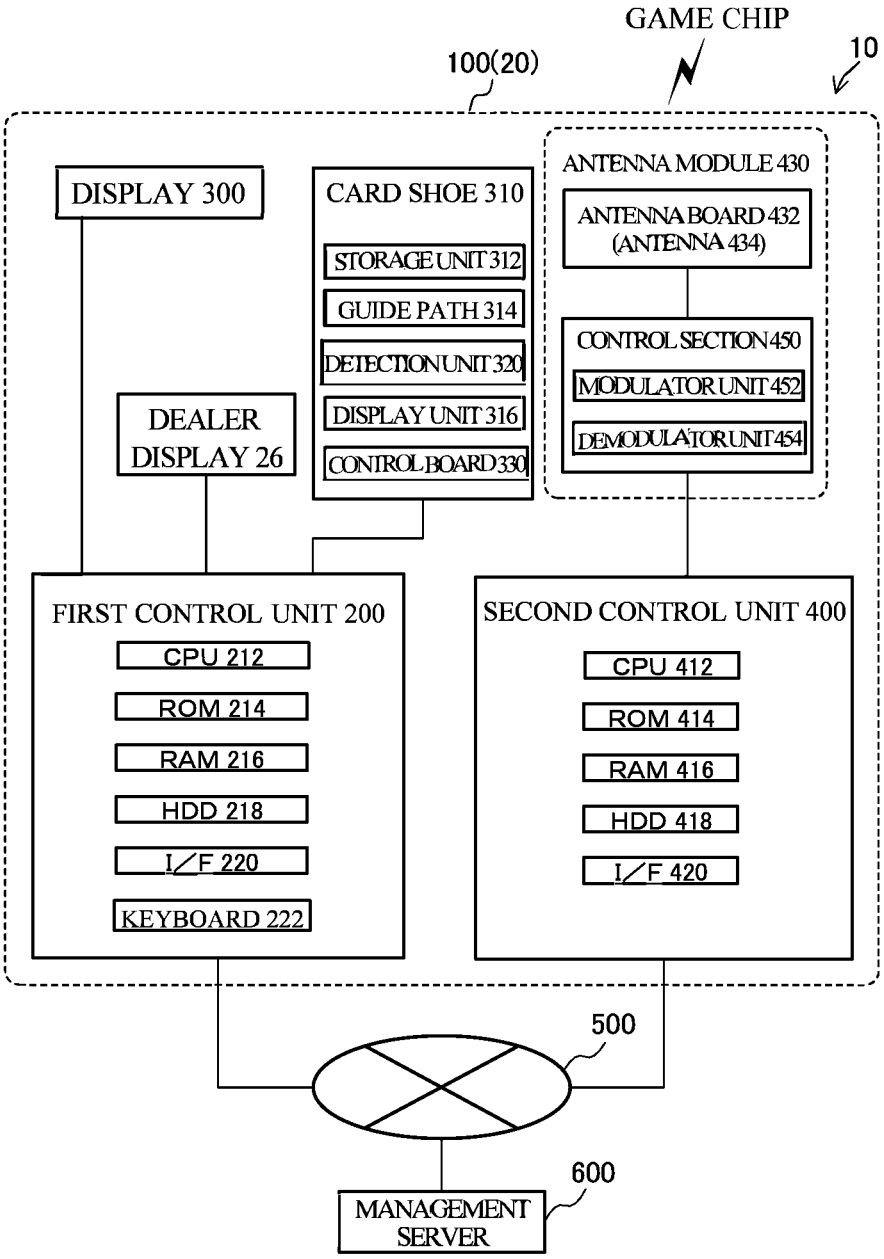
FIG. 1 is a functional block diagram schematically illustrating a gaming table apparatus system.

An embodiment of the invention will be described in detail below with reference to the accompanying drawings. FIG. 1 is a functional block diagram schematically illustrating a gaming table apparatus system 10. The gaming table apparatus system 10 is installed in a gaming facility such as a casino.

Figure 2:
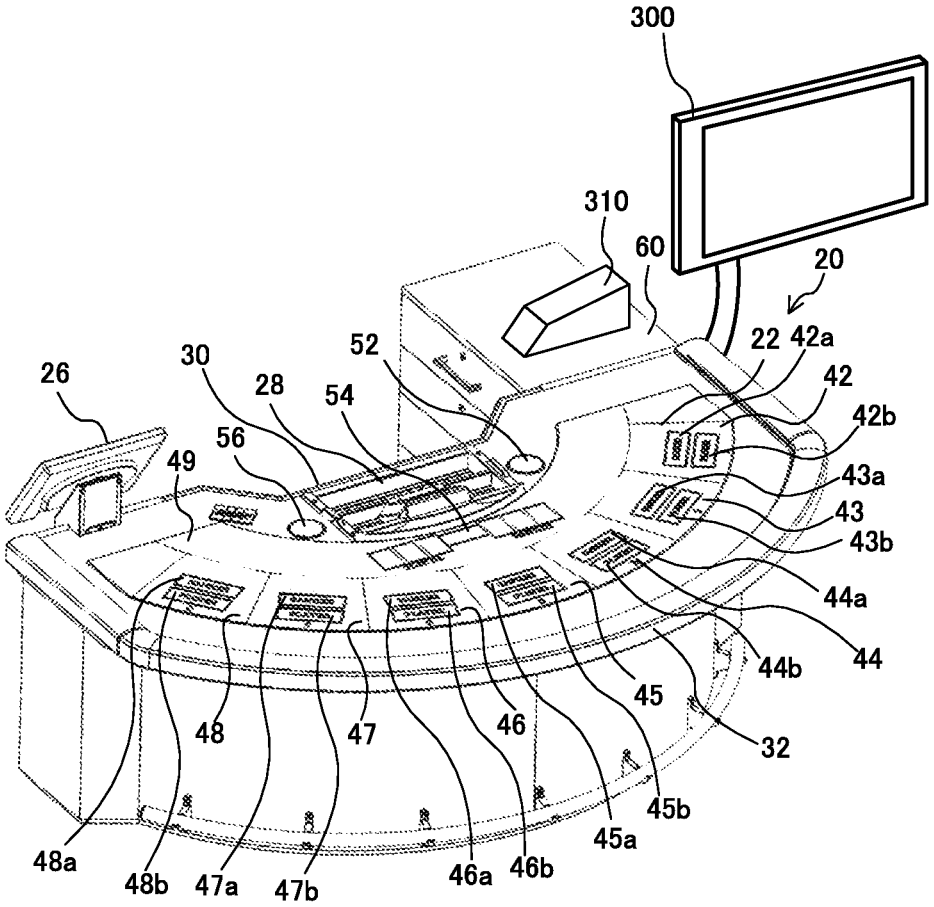
FIG. 2 is a perspective view illustrating a gaming table according to an embodiment as seen from players.

The gaming table apparatus system 10 includes a gaming table apparatus 100, a network 500, and a management server 600. As illustrated in FIG. 2, the gaming table apparatus 100 has a to gaming table 20 (so-called casino table).

The gaming table apparatus 100 includes a first control unit 200, a game result reporting display 300, a card shoe 310, and a second control unit 400, antenna modules 430.

The first control unit 200 is configured by a computer and mainly includes a CPU (central processing unit) 212, a ROM (read-only memory) 214, a RAM (random access memory) 216, a HDD (hard disk drive) 218, a communication I/F (communication interface) 220, a keyboard 222, and the like and these components are communicably connected via a data bus and an address bus (not illustrated). The ROM 214 stores character information and color information displayed on a dealer display 26 for each player according to the destination to which a game proceeds.

The game result reporting display 300 is connected to the first control unit 200. Under control of the first control unit 200, the game result reporting display 300 displays information about the result of a game played on the gaming table 20 (see FIG. 2), for example, win and loss and information about win and loss. The players can visually recognize various types of information displayed on the game result reporting display 300. The information displayed on the game result reporting display 300 will be described in detail later.

The card shoe 310 is connected to the first control unit 200. The card shoe 310 is operated by the dealer. The card shoe 310 accommodates game cards such as a plurality of playing cards. The dealer takes game cards from the card shoe 310 and places the game cards on the gaming table 20.

The identification information of the game cards taken from the card shoe 310 is transmitted to the first control unit 200. The first control unit 200 decides the progress and result of the game based on the identification information of the cards transmitted from the card shoe 310. The card shoe 310 will be described in detail later.

The second control unit 400 is configured by a computer and mainly includes a CPU (central processing unit) 412, a ROM (read-only memory) 414, a RAM (random access memory) 416, a HDD (hard disk drive) 418, a communication I/F (communication interface) 420 and these components are communicably connected via a data bus and an address bus (not illustrated).

The antenna modules 430 are communicably connected to the second control unit 400. The antenna modules 430 read the identification information of a game chip and transmit the read information to the second control unit 400. The antenna modules 430 will be described in detail later.

The network 500 communicably connects the first control unit 200 and the second control unit 400 to the management server 600. The network 500 may be formed inside or outside the gaming facility.

The management server 600 mainly manages information about a game such as game chips and players. Game chips are media having cash values in a gaming facility. All game chips used in the gaming facility are managed by the management server 600. Each of all game chips has different chip identification information. The state of a game chip is managed based on chip identification information. The state of a game chip is the state held by a player, the state stored by the gaming facility, and the like. The management server 600 manages these types of information as a database. Each time the state of a game chip changes, the database is updated.

The management server 600 may be installed inside or outside the gaming facility. The management server 600 only needs to be communicably connected to the network 500 to manage information about games.

Next, the gaming table 20 in the embodiment will be described. FIG. 2 is a perspective view illustrating the gaming table 20 according to the embodiment as seen from the players.

The gaming table 20 mainly includes a gaming board 22, the card shoe 310, the dealer display 26, and a chip tray 28.

The gaming table 20 includes a dealer section 30 and a player section 32. The dealer section 30 is an inside of the gaming table 20 in which the dealer is positioned. The player section 32 is an outside of the gaming table 20 in which the plurality of players (for example, seven players) are positioned. The dealer faces the player across the gaming table 20 and various types of games such as baccarat, poker, blackjack, and Casino War are played on the gaming table 20. On the gaming table 20, as the game proceeds, game cards such as playing cards and game chips are placed or collected.

The gaming board 22 is substantially fan-shaped. The gaming board 22 is provided with bet areas 42 to 48 for seven players. The bet areas 42 to 48 are areas in which the game chips owned by the players can be betted. In addition, the bet areas 42 to 48 include Ante areas 42*a* to 48*a* in which game chips for competing the game can be placed (betted) and Tie areas 42*b* to 48*b* in which game chips are placed (betted) with a tie predicted. In addition, a sheet (not illustrated) on which, for example, indications of bet areas are printed is pasted to the bet areas 42 to 48.

A dealer area 49 is also formed in the gaming board 22. The dealer area 49 is used by the dealer.

On the back side (not illustrated) of the gaming board 22, the seven antenna modules 430 (see FIG. 1) that correspond to the bet areas 42 to 48 are provided. Similarly, the dealer area 49 is provided with one antenna module 430.

The antenna modules 430 are provided with a plurality of antennas 434 that corresponds to the bet areas 42 to 48. The game chip includes an RFID (radio frequency identifier) IC tag. The RFID IC tag stores chip information. The chip information includes various types of information such as chip identification information for identifying the game chip. When the game chip is placed in a bet area, the chip information stored in the RFID IC tag can be read via the antenna 434. At this time, to reduce read error of the chip information stored in the RFID IC tag, the chip information is always read three times by the antenna module 430.

The antenna modules 430 are communicably connected to a control section 450 and the second control unit 400 installed in the gaming table 20. The chip information read by the antenna modules 430 via the antennas 434 is transmitted to the second control unit 400 via the control section 450. The structure and operation of the antenna modules 430 will be described later.

The dealer section 30 is provided with three types of antenna devices: a deletion antenna device 52, a reference antenna device 54, and a registration antenna device 56. The deletion antenna device 52 is provided on the left side of the chip tray 28, the reference antenna device 54 is provided on the back side (player section 32) of the chip tray 28, and the registration antenna device 56 on the right side of the chip tray 28. The dealer is position in front of the chip tray 28.

The deletion antenna device 52 is used to delete information about players, for example, player identification information for identifying players. The registration antenna device 56 is used to register player identification information. The deletion antenna device 52, the reference antenna device 54, the registration antenna device 56, and the like in addition to the management server 600 are connected to the second control unit 400.

The management server 600 in the gaming facility deletes or registers player identification information by collecting, via the second control unit 400 of the gaming table 20, various types of information received via the antenna modules 430. The management server 600 makes correspondence between chip identification information and player identification information and stores the correspondence in a database. The management server 600 updates the correspondence between chip identification information and player identification information based on various types of information transmitted from the second control unit 400.

Player identification information is deleted in the following procedure. First, chip identification information is read by the deletion antenna device 52 from a game chip. The second control unit 400 of the gaming table 20 transmits the read chip identification information to the management server 600. The management server 600 deletes the player identification information that corresponds to the received chip identification information from the database. This releases and invalidates the correspondence (relation) between chip identification information and player identification information. This game chip is returned from the player to the gaming facility and stored by the gaming facility.

Player identification information is registered in the following procedure. First, chip identification information is read by the registration antenna device 56 from a game chip. The second control unit 400 of the gaming table 20 transmits the read chip identification information and the player identification information corresponding to the game chip to the management server 600. The management server 600 receives the chip identification information and the player identification information, makes correspondence between the chip identification information and the player identification information, and stores the correspondence in the database. This forms and validates the correspondence (relation) between the chip identification information and the player identification information. This game chip loaned to the player by the gaming facility and held by the player.

The reference antenna device 54 is an antenna used by the dealer to check a game chip. The dealer takes a game chip from the chip tray 28, performs registration processing, and then distributes the game chip to a player. The dealer can check whether the game chip has undergone registration processing using the reference antenna device 54.

When collecting the game chip from the player, the dealer performs deletion processing and then accommodates the game chip in the chip tray 28. The dealer can check whether the game chip has undergone deleting processing using the reference antenna device 54 before accommodating the game chip in the chip tray 28.

The dealer display 26 is provided in the right end part of the dealer section of the gaming table 20. The dealer display 26 is connected to the first control unit 200 of the gaming table 20. The first control unit 200 displays various types of information such as the identification information of players, the information of other game chips, and the information of a game on the dealer display 26 according to the amounts of the chips betted in the bet areas 42 to 48 obtained via the network 500 and the management server 600 from the second control unit 400, the contents of the game cards taken from the card shoe 310 and distributed to the bet areas 42 to 48 or the dealer area 49, the progress of the game, and the like.

The chip tray 28 is provided in the front part of the dealer section 30. The chip tray 28 is detachable with respect to the gaming table 20. The chip tray 28 accommodates game chips to be distributed to players and game chips collected from players. When the dealer leaves the gaming table 20, the dealer detaches the chip tray 28 and carries the entire chip tray 28. The game chips accommodated in the chip tray 28 are managed by a gaming facility such as the dealer.

A chip stocker 60 is disposed in the part of the gaming table 20 to the left of the dealer. The chip stocker 60 is disposed near the deletion antenna device 52. The chip stocker 60 accommodates reserve game chips to be used by the dealer. All game chips accommodated in the chip stocker 60 are invalidated.

As illustrated in FIG. 1, the gaming table apparatus 100 includes the second control unit 400 and the antenna modules 430. The antenna module 430 has an antenna board 432 and the control section 450.

The antennas 434 are formed in the antenna board 432 and provided in the antenna modules 430. As described above, game chips are placed on the gaming table 20 by the players or the dealer. The control section 450 wirelessly communicates with the RFID IC tags of the game chips placed on the gaming table 20 via the antennas 434.

As described above, the plurality of antenna modules 430 is provided in the gaming table apparatus 100 so as to correspond to the bet areas 42 to 48 and the dealer area 49. It should be noted here that only one antenna module 430 is typically illustrated in FIG. 1.

The control section 450 is communicably connected to the second control unit 400. The control section 450 communicates with the RFID IC tags of the game chips via the antennas 434 according to an instruction received from the second control unit 400. The control section 450 receives the chip identification information from the RFID IC tags. The control section 450 transmits the received chip identification information to the second control unit 400.

The control section 450 is configured by a microcomputer including, for example, a CPU, a ROM, and a RAM, which are not illustrated. The control section 450 has a modulator unit 452 and a demodulator unit 454. The control section 450 includes, for example, an RF module having a modulation circuit and a demodulation circuit and the like.

The modulator unit 452 modulates a carrier wave using a predetermined modulation system based on information such as a predetermined command, request, instruction received by the control section 450 to generate a modulated wave (modulated signal) and outputs the generated modulated wave as an RF signal. The output RF signal is supplied to the antennas 434 and emitted as an electromagnetic wave from the antennas 434.

The modulated wave received by the antennas 434 is supplied as a modulated signal to the demodulator unit 454. This modulated wave is an electromagnetic wave obtained by modulating the carrier wave using the predetermined modulating system based on the chip information stored in the RFID IC tags of the game chips. The demodulator unit 454 demodulates the modulated signal supplied from the antennas 434 and reads the chip information stored in the RFID IC tags.

As described above, the control section 450 can wirelessly communicate with the RFID IC tags of the game chips placed in the bet areas 42 to 48 and the dealer area 49 by transmitting and receiving an electromagnetic wave via the antennas 434 of the antenna board 432.

Figure 3:
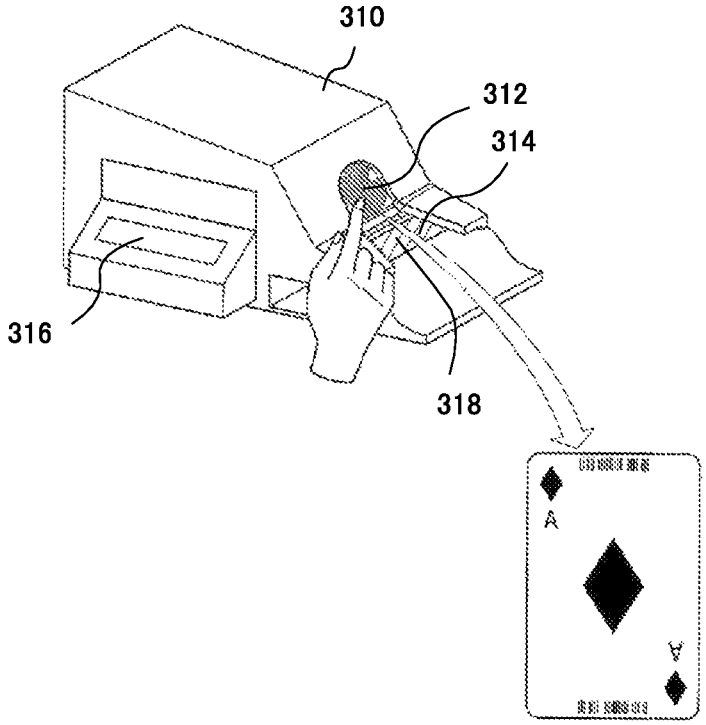
FIG. 3 is a perspective view illustrating an entire card shoe.
Figure 4:
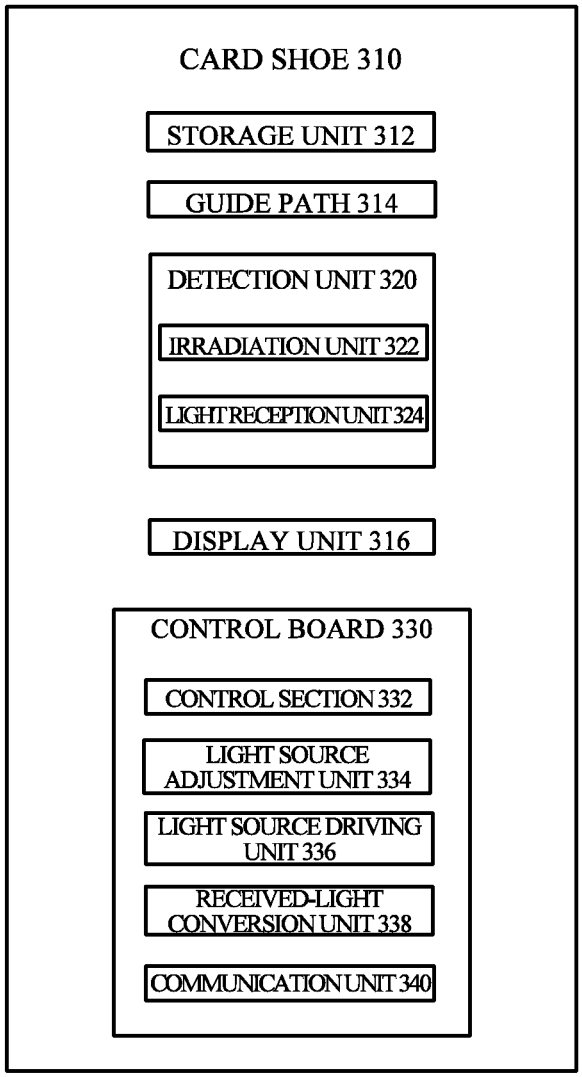
FIG. 4 is a functional block diagram schematically illustrating the card shoe.

As illustrated in FIG. 2, the card shoe 310 is disposed in the chip stocker 60. As illustrated in FIG. 2, FIG. 3, and FIG. 4, the card shoe 310 includes a storage unit 312, a guide path 314, a detection unit 320, a display unit 316, and a control board 330.

The storage unit 312 stores the plurality of game cards laminated with each other. In the storage unit 312, the game cards are stored with the front side thereof facing downward. The storage unit 312 has a number-of-cards detection sensor (not illustrated) capable of detecting the number of stored game cards.

The guide path 314 guides the game cards taken from the storage unit 312 to a card ejection end 318.

The display unit 316 displays the identification information of the game cards. The identification information of the game cards is identified by the control board 330, which will be described later. The identification information of the game cards is specific to the game cards and includes suit information and numerical information. The suit information and the numerical information are drawn on the game cards. The suit information includes four types of information including hearts, diamonds, clubs, and spades. The numerical information includes 13 types of information including numerals from 2 to 10, J (JACK), Q (QUEEN), K (KING), and A (ACE).

The detection unit 320 has an irradiation unit 322 and a light reception unit 324. The irradiation unit 322 emits infrared light. The infrared light emitted from the irradiation unit 322 irradiates the game cards. The game cards are manually moved in the guide path 314 by the dealer. The infrared light irradiates the game cards positioned in the guide path 314.

The light reception unit 324 receives the reflected light of the infrared light having irradiated the game cards. The light reception unit 324 includes a plurality of long light receiving elements (not illustrated). The plurality of light receiving elements is arranged in rows and disposed in parallel with the longitudinal direction of the game cards that move in the guide path 314. As described above, the suit information and numerical information are drawn on the game cards and the reflected light includes suit information and numerical information.

The control board 330 includes a control section 332, a light source adjustment unit 334, a light source driving unit 336, a received-light conversion unit 338, and a communication unit 340.

The control section 332 includes a CPU, a ROM, a RAM, which are not illustrated, and the like. The light source adjustment unit 334 adjusts the amount of emission of infrared light generated from the irradiation unit 322. The light source driving unit 336 emits infrared light when the game card is positioned in the guide path 314. The received-light conversion unit 338 converts the amount of reflected light received by the light reception unit 324 into an analog signal and outputs the analog signal to an analog-to-digital converter (not illustrated). The control section 332 converts image data obtained from a digital signal into the identification information of the game card.

The communication unit 340 is communicably connected to the first control unit 200. The communication unit 340 outputs the identification information of the game card to the first control unit 200. The first control unit 200 decides the progress of the game based on the suit information and the numerical information included in the identification information of the game card.

In addition, when the number of game cards stored in the storage unit 312 is equal to or less than a predetermined number, the communication unit 340 outputs a card supply signal that instructs supply of cards to the first control unit 200.

As described above, the display unit 316 displays the identification information of the game card identified by the control board 330. The dealer can check if the identification information displayed on the display unit 316 matches the identification information of the game card take from the card shoe 310.

The control board 330 performs conversion into the identification information of the game card based on the analog signal output from the detection unit 320. However, depending on the state of the detection unit 320, the state of the game card, or the state of the guide path 314, conversion into information different from the identification information of the taken game card may be performed. In addition, conversion into the identification information of the game card cannot be performed and an error may occur. For example, conversion into the identification information of the game card is affected by soil attached to the game card, dust on the detection unit 320, or the like.

Accordingly, the dealer visually checks whether the information displayed on the display unit 316 matches the identification information of the game card taken actually. When the information displayed on the display unit 316 is different from the identification information of the game card taken actually, the dealer inputs the identification information of the game card taken actually by operating the keyboard 222. The identification information of the game card input from the keyboard 222 is output to the first control unit 200 as the true identification information, stored in the RAM 216, and then the result of the game is decided. This ensures the fairness of the game.

The card shoe 310 described above optically obtains the identification information of the game card using the detection unit 320. In recent years, game cards including RFID tags may be used. The RFID tag stores the identification information of a game card. When a game card having an RFID tag is used, it is enough to read the identification information of the game card from the RFID tag by providing an antenna for reading the RFID tag in the card shoe 310 or the gaming table 20.

In addition, even when a game card having an RFID tag is used, the identification information of the game card may be optically detected while the identification information of the game card is read from the RFID tag. By comparing the identification information read from the RFID tag with the identification information optically detected, the true identification information of the game card can be easily decided.

Furthermore, the gaming table 20 may have a monitor camera (not illustrated). Such a monitor camera may be used to take a picture of a game card and detect the identification information of the game card to make comparison. The true identification information of the game card can be decided more easily.

(Game Processing)

FIG. 5 to FIG. 11 illustrate examples of images displayed on the dealer display 26 under control of the first control unit 200 according to the progress of the game performed by the first control unit 200. In the embodiment, Casino War is illustrated as the game. When Casino War is played on the gaming table 20, the images illustrated in FIG. 5 to FIG. 11 are displayed on the dealer display 26.

Casino War is a game using game cards in which a one-to-one fight is performed between each player and the dealer and either the dealer or the player having a stronger distributed game card wins. In this game, the order from strongest to weakest is "A", "K", "Q", "J", "10", . . . , and "2". The embodiment assumes a game (Casino War) in which one dealer competes against seven players playing the game in the bet areas 42 to 48 (FIG. 2).

As illustrated in FIG. 5 to FIG. 11, the first control unit 200 displays information about the bet areas 42 to 48 (FIG. 2) on the dealer display 26. Specifically, Box 1 to Box 7 are areas that display, for each of the bet areas (for each of the players), the amounts of the game chips placed in the Ante areas 42*a* to 48*a* by the players playing games in the bet areas 42 to 48 (FIG. 2), the amounts of the game chips placed in the Tie areas 42*b* to 48*b* by the players, and the contents of the cards distributed to the bet areas 42 to 48 (that is, the players) by the dealer.

When the players playing in the bet areas 42 to 48 are indicated, the players may be indicated so as to correspond to Box 1 to Box 7 displayed in the dealer display 26. Specifically, the player playing in the bet area 42 may be indicated as Box 1, the player playing in the bet area 43 may be indicated as Box 2, and so on.

In Casino War, the players first place the game chips corresponding to desired bets on the gaming board 22. At this time, the parts of the gaming board 22 in which the players place the game chips are the Ante areas 42*a* to 48*a* and/or the Tie areas 42*b* to 48*b*. It should be noted here that the players may place the game chips in both the Ante areas 42*a* to 48*a* and the Tie areas 42*b* to 48*b* at the same time.

When the first game starts, the first control unit 200 obtains the amounts of chips placed in the Ante areas 42*a* to 48*a* and the Tie areas 42*b* to 48*b* of the bet areas 42 to 48 via the antenna modules 430, the second control unit 400, the network 500, and the management server 600 and displays the obtained amounts in a Box 1 display area B1, a Box 2 display area B2, a Box 3 display area B3, a Box 4 display area B4, a Box 5 display area B5, a Box 6 display area B6, and a Box 7 display area B7. Specifically, the amounts of chips placed in the Ante areas 42*a* to 48*a* are displayed in Ante display areas BA1 to BA7 of the Box 1 display area B1 and the amounts of chips placed in the Tie areas 42*b* to 48*b* are displayed in Tie display areas BT1 to BT7 of the Box 1 display area B1. It should be noted here that the bet areas 42 to 48 can be distinguished by identifying which antenna modules 430 have output the information because one antenna module 430 is provided for each of the bet areas 42 to 48.

Figure 5A:
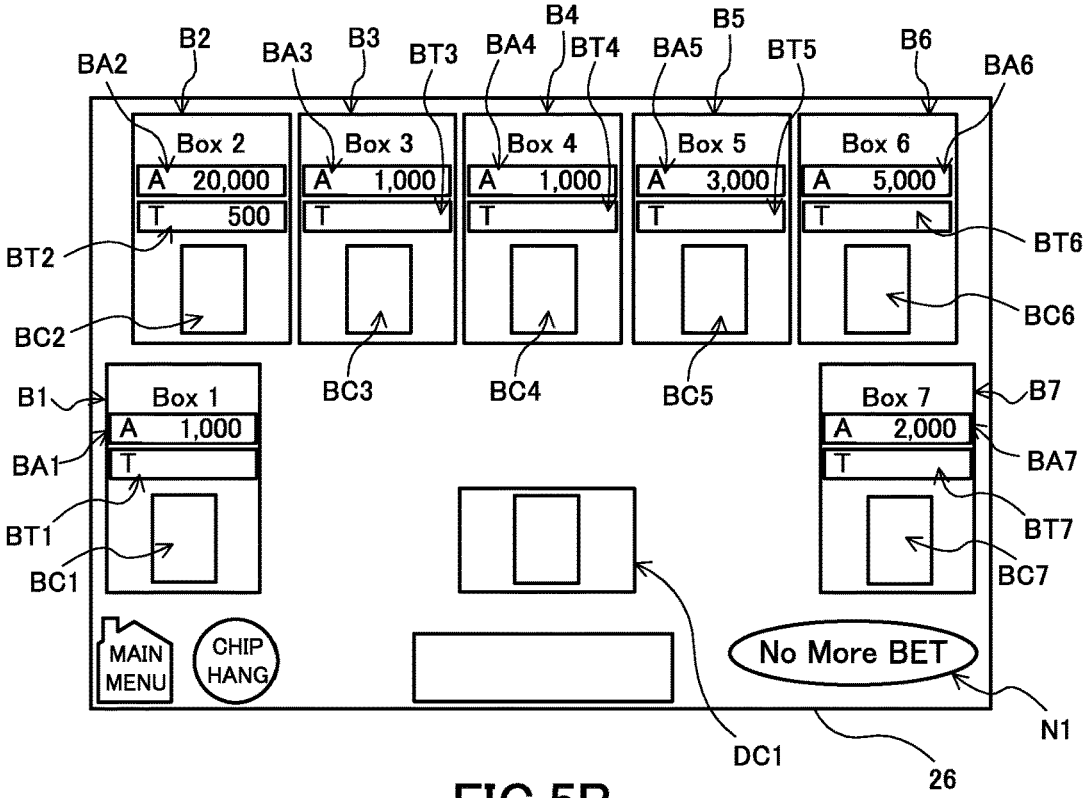
FIGS. 5A and 5B illustrate examples of images displayed on a dealer display.
Figure 5B:
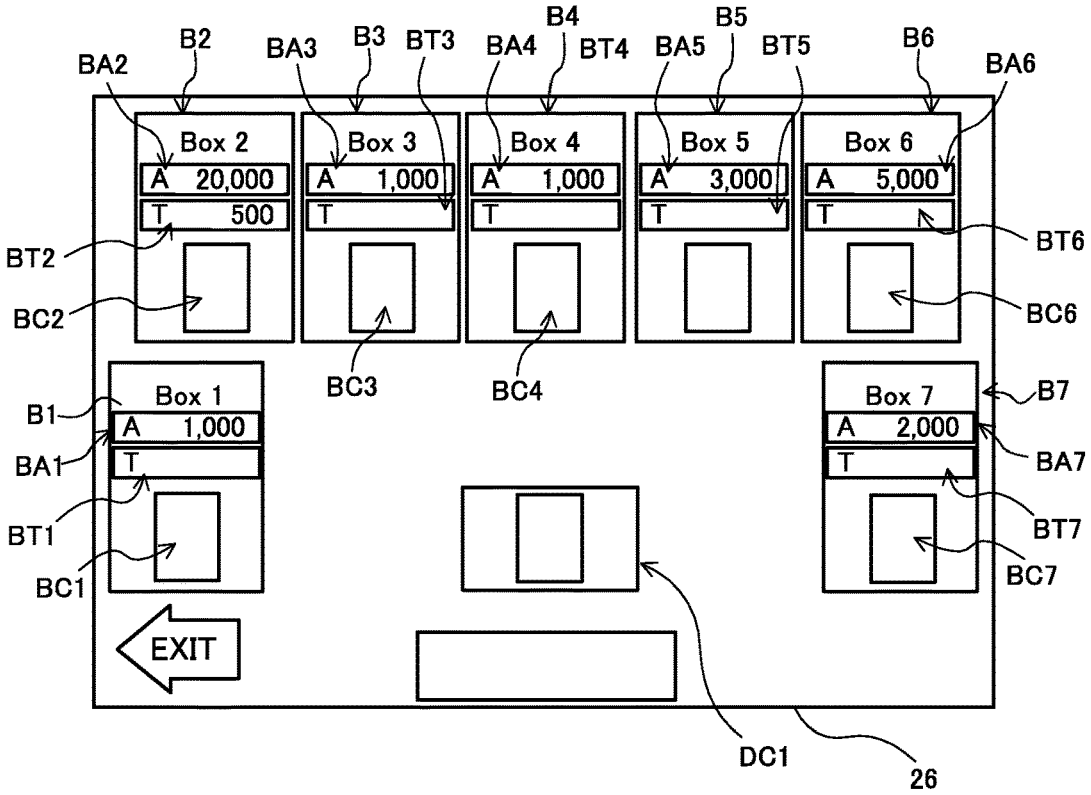

Accordingly, the dealer can check the amounts (amounts corresponding to the game chips placed in the bet areas 42 to 48) of game chips betted by the players with reference to the waiting screen illustrated in FIG. 5A.

For example, as illustrated in FIG. 5A, it can be seen from the dealer display 26 that Box 1 bets the game chips corresponding to "$1,000", Box 2 bets the game chips corresponding to "$20,000", Box 3 bets the game chips corresponding to "$1,000", Box 4 bets the game chips corresponding to "$1,000", Box 5 bets the game chips corresponding to "$3,000", Box 6 bets the game chips corresponding to "$5,000", and Box 7 bets the game chips corresponding to "$2,000" in the Ante areas 42*a* to 48*a*. In addition, it can be seen that only Box 1 bets the game chips corresponding to "$500" in the Tie areas 42*b* to 48*b*.

By the way, the dealer display 26 is provided with card display areas BC1 to BC7 that display the contents of the game cards distributed to the players (bet areas 42 to 48) and a dealer card display area DC1 that displays the content of the game card distributed to the dealer (dealer area 49), and the first control unit 200 displays the contents of the cards distributed from the card shoe 310 to the dealer in these display areas according to the progress of the game.

After a lapse of a predetermined time from the start of betting, the dealer informs the players that the bet period has been completed and inputs the completion of the bet period to the first control unit 200 by touching a "No More Bet" area N1, which is a touch panel component of the dealer display 26. This causes the first control unit 200 to switch the screen of the dealer display 26 to the bet confirmation screen illustrated in FIG. 5B.

In addition, when the bet period is completed, the dealer takes game cards from the card shoe 310 and distributes the game cards to the players (bet areas 42 to 48), one for each, with the surface including suit information and numerical information facing upward and, finally, distributes one of the game cards to himself (dealer area 49) with the surface including suit information and numerical information hidden. After that, the dealer turns over his game card, compares it with the game cards of the player, and determines which of them wins the game. When the first control unit 200 determines that all game cards required for the game have been taken based on identification information output from the card shoe 310 each time a game card is distributed, the first control unit 200 switches the display on the dealer display 26 to a first game result screen illustrated in FIG. 6A and determines which of them wins the game for each of the players based on the contents (suit information and numerical information) of the game cards distributed to the players and the content (suit information and numerical information) of the game card distributed to the dealer. The first control unit 200 displays the Box display areas (Box 1 display area B1 to Box 7 display area B7) corresponding to the players in different colors according to the decision results of win, lose, or tie of the game.

Figure 6A:
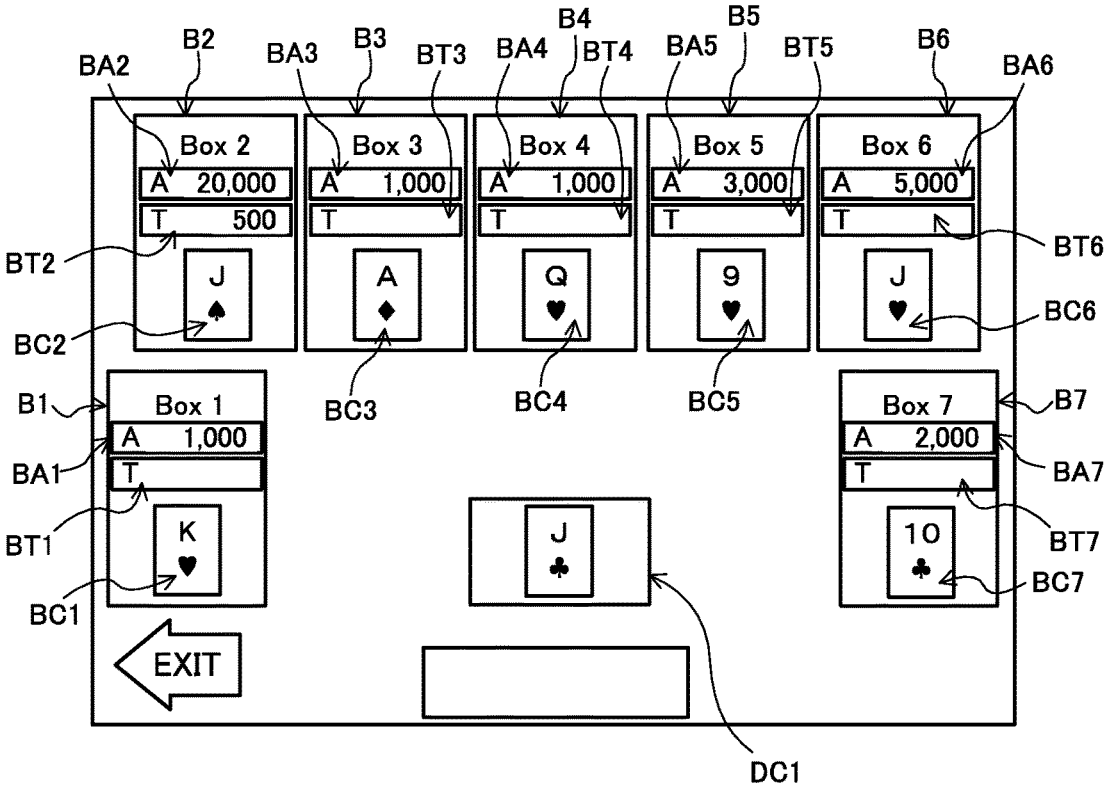
FIGS. 6A and 6B illustrate examples of images displayed on the dealer display.

As illustrated in FIG. 6A, the first control unit 200 displays the contents of the game cards taken from the card shoe 310 and sequentially distributed to the bet areas 42 to 48 (that is, the players) and the dealer in the card display areas BC1 to BC7 of the Box display areas (Box 1 display area B1 to Box 7 display area B7). The order in which the game cards are taken from the card shoe 310, that is, the order in which the game cards are distributed to the bet areas 42 to 48 (for the players) and the dealer area 49 (for the dealer) is determined in advance (for example, the order of the bet areas 42, 43, 44, 45, 46, 47, and 48 and then the dealer area 49). On assumption that the cards are distributed from the card shoe 310 to the bet areas 42 to 48 in this order, each time a game card is taken from the card shoe 310, the type (identification information) of the game card decided by the detection unit 320 of the card shoe 310 is transmitted from the card shoe 310 to the first control unit 200 and the types are displayed as corresponding images in the card display areas BC1 to BC7 of the Box display areas (Box 1 display area B1 to Box 7 display area B7) of the dealer display 26. The corresponding images represent the contents (suit information and numerical information) of the game cards taken from the card shoe 310.

The first control unit 200 decides the win or lose of the game based on the amounts of chips betted in the bet areas 42 to 48, information of the game cards distributed to the players and the card distributed to the dealer, and the like and determines the subsequent progress of the game based on the decision result. That is, the first control unit 200 selects any of programs that execute the contents of a plurality of games stored in the ROM 214 in advance according to the win or lose of the game and executes the selected game as the subsequent game content. In addition, the first control unit 200 displays the decision result (win or lose) and the content of determination (selection) thereof on the dealer display 26 and displays information such as the game result that needs to be displayed for the players on the game result reporting display 300.

FIG. 6A illustrates the game card distributed to the dealer is "J of clubs", the game card distributed to Box 1 is "K of hearts", the game card distributed to Box 2 is "J of spades", the game card distributed to Box 3 is "A of diamonds", the game card distributed to Box 4 is "Q of hearts", the game card distributed to Box 5 is "9 of hearts", the game card distributed to Box 6 is "J of hearts", and the game card distributed to Box 7 is "10 of clubs". Accordingly it can be seed from these display contents that the players who win against the dealer are Box 1, Box 3, and Box 4 and the players who lose are Box 5 and Box 7, and the players who tie are Box 2 and Box 6. In this case, the first control unit 200 displays the Box 1 display area B1, the Box 3 display area B3, and the Box 4 display area using the color representing that the game result is "win", displays the Box 5 display area B5 and the Box 7 display area B7 using the color representing that the game result is "lose", and displays the Box 2 display area B2 and the Box 6 display area B6 using the color representing that the game result is tie.

Figure 6B:
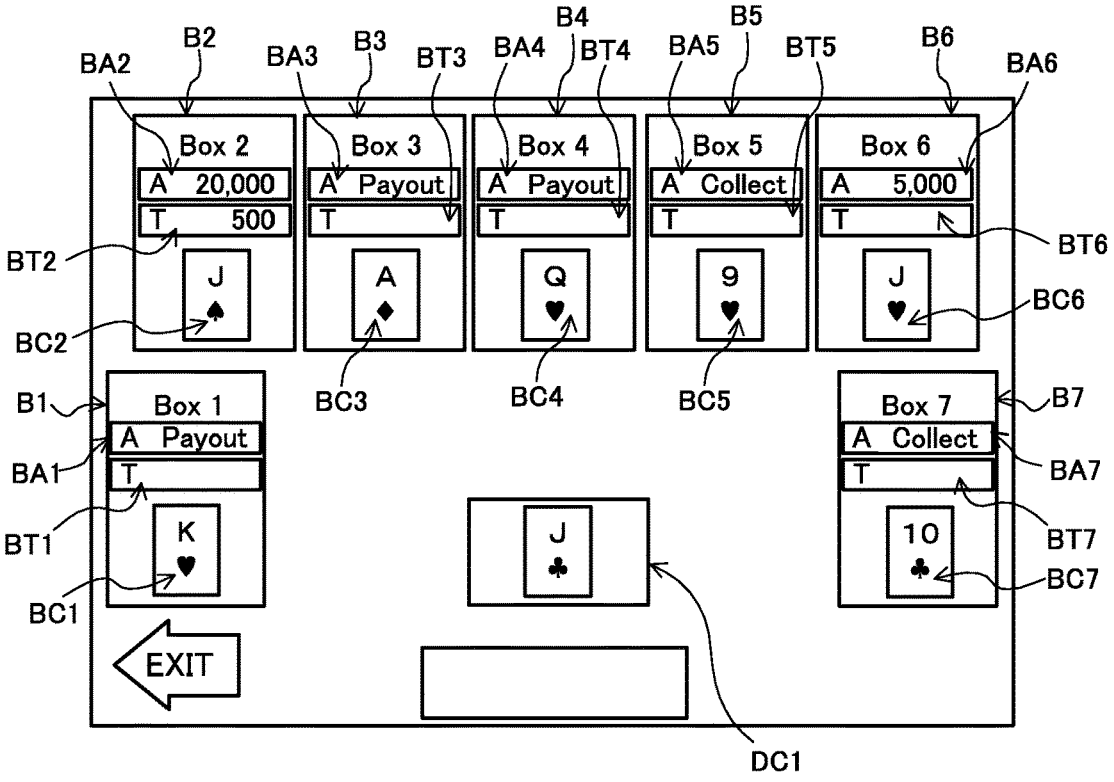

The first control unit 200 performs a switchover to a first payout and collection screen illustrated in FIG. 6B 0.6 seconds after displaying the first game result screen (FIG. 6A). As for the dividend after determination of win and lose in the first comparison, when a player wins, the amount equal to the amount corresponding to the game chips placed by the player on his Ante area (one of the Ante areas 42*a* to 48*a*) is paid to the player as the dividend. When the player loses, all of the game chips betted by the player who loses on his Ante area (one of the Ante areas 42*a* to 48*a*) are collected. In addition, if the player ties with the dealer when the player places the game chips on his Tie area (one of the Tie areas 42*b* to 48*b*), ten times the amount corresponding to the game chips placed by the player who ties on his Tie area (one of the Tie areas 42*b* to 48*b*) is paid to the player as the dividend. However, if the player does not tie with the dealer when the game chips are placed on his Tie areas 42*b* to 48*b*, the game chips placed on the Tie areas 42*b* to 48*b* are collected by the dealer. Accordingly, in the embodiment, the game chips corresponding to the amounts equal to the amounts betted by Box 1, Box 3, and Box 4 are paid to Box 1, Box 3, and Box 4, the game chips corresponding to the amounts betted by Box 5 and Box 7 are collected by the dealer, and ten times the amount betted in a Tie area 43*b* is paid as the dividend to Box 2 who ties.

The first control unit 200 transmits the game results (win, lose, or tie) of the players to the management server 600. The management server 600 performs calculation and processing of payout or collection based on the game results received from the first control unit 200. On assumption that the dealer performs this payout or collection correctly, the first control unit 200 receives, from the management server 600, the results of the automatic calculation and processing performed by the management server 600 and displays the results on the dealer display 26. Specifically, as in the first payout/collection screen illustrated in FIG. 6B, "Payout" is displayed in the Ante display areas BA1, BA3, and BA4 corresponding to the Ante areas 42*a*, 44*a*, and 45*a* of Box 1, Box 3, and Box 4 and "Collect" is displayed in the Ante display areas BA5 and BA7 corresponding to the Ante areas 46*a* and 48*a* of Box 5 and Box 7. In addition, the screen aspects of the Box 2 display area B2 and the Box 6 display area B6 corresponding to Box 2 and Box 6 who tie with the dealer are similar to those in the first game result screen in FIG. 6A. It should be noted here that, when no players tie in this first comparison, the game is completed as is, the screen displayed on the dealer display 26 returns from the first payout/collection screen in FIG. 6B to the waiting screen in FIG. 5A, and the players can start a new game by betting game chips.

Figure 7A:
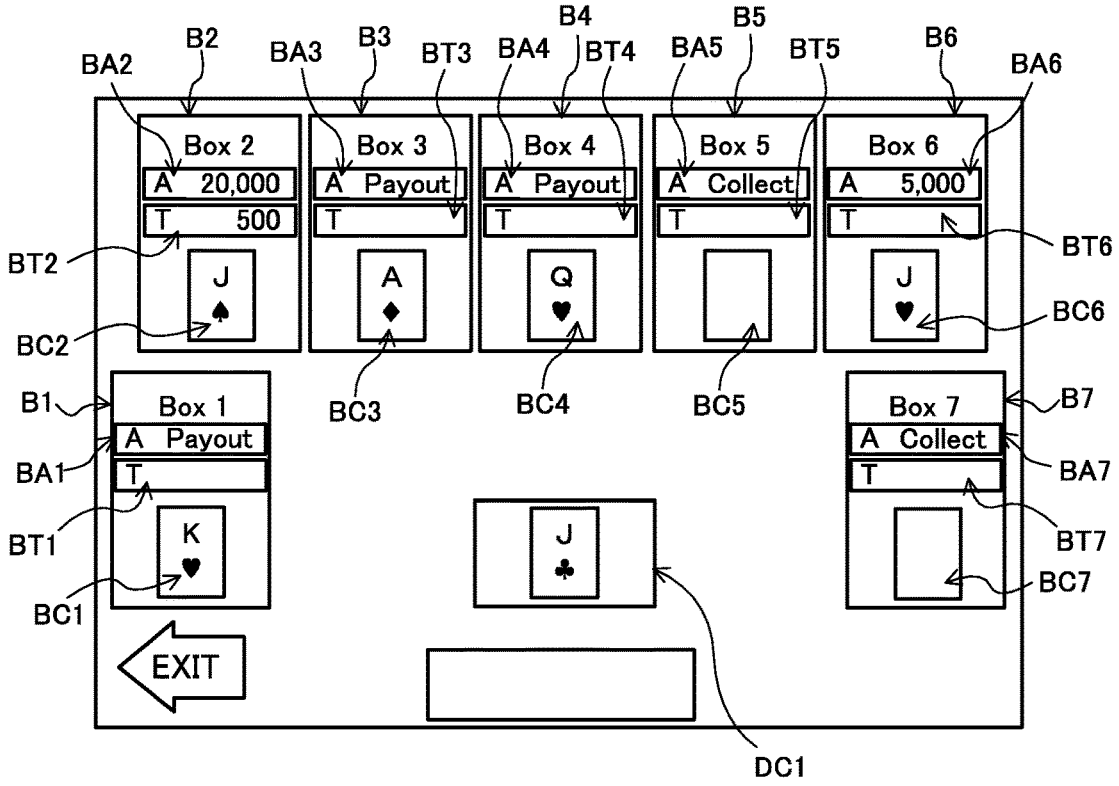
FIGS. 7A and 7B illustrate examples of images displayed on the dealer display.
Figure 7B:
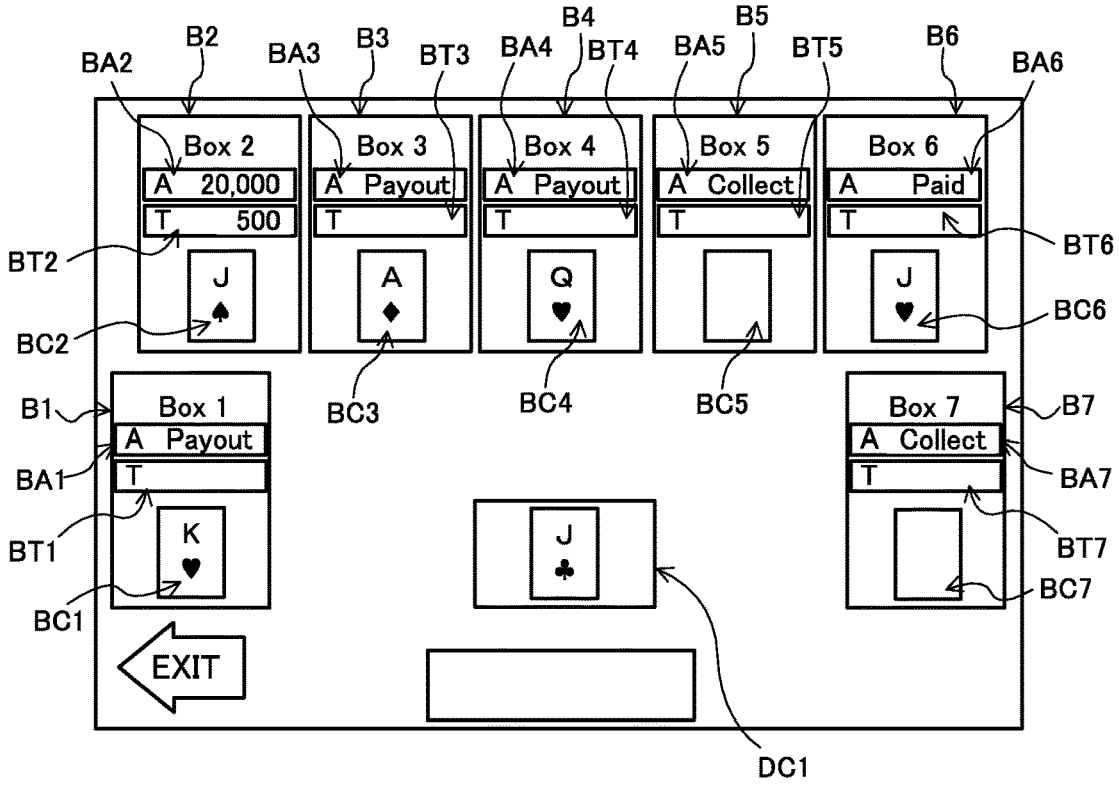
Figure 8A:
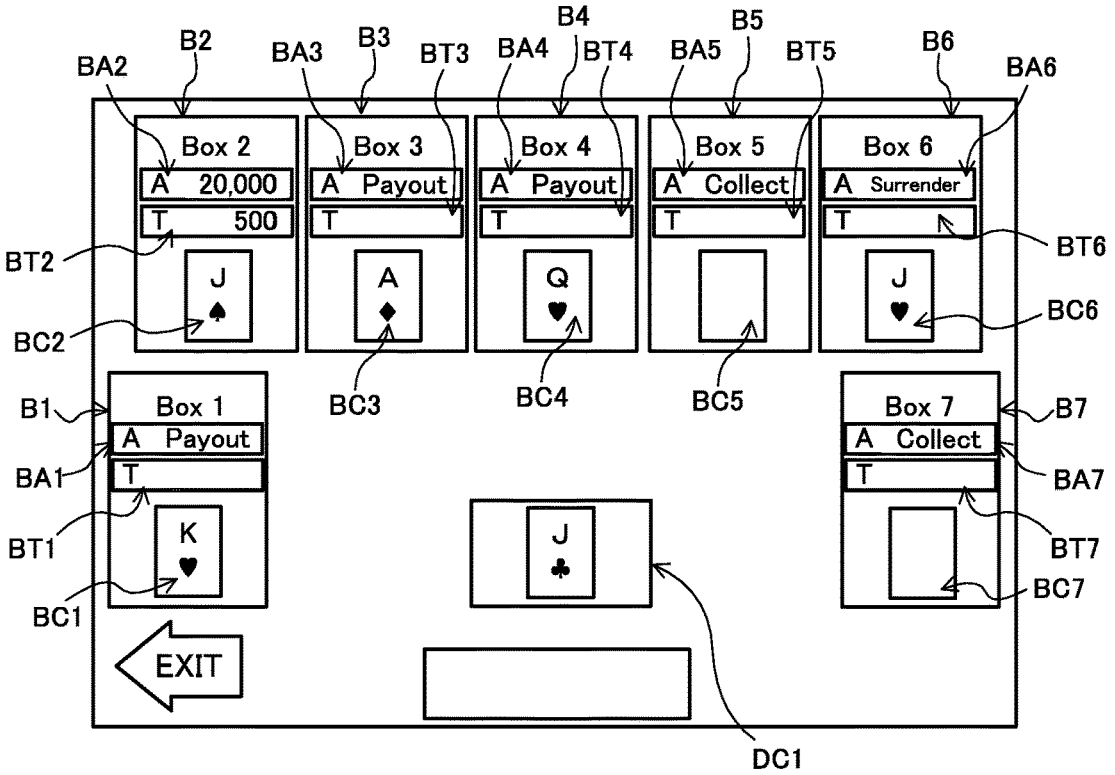
FIGS. 8A and 8B illustrate examples of images displayed on the dealer display.
Figure 8B:
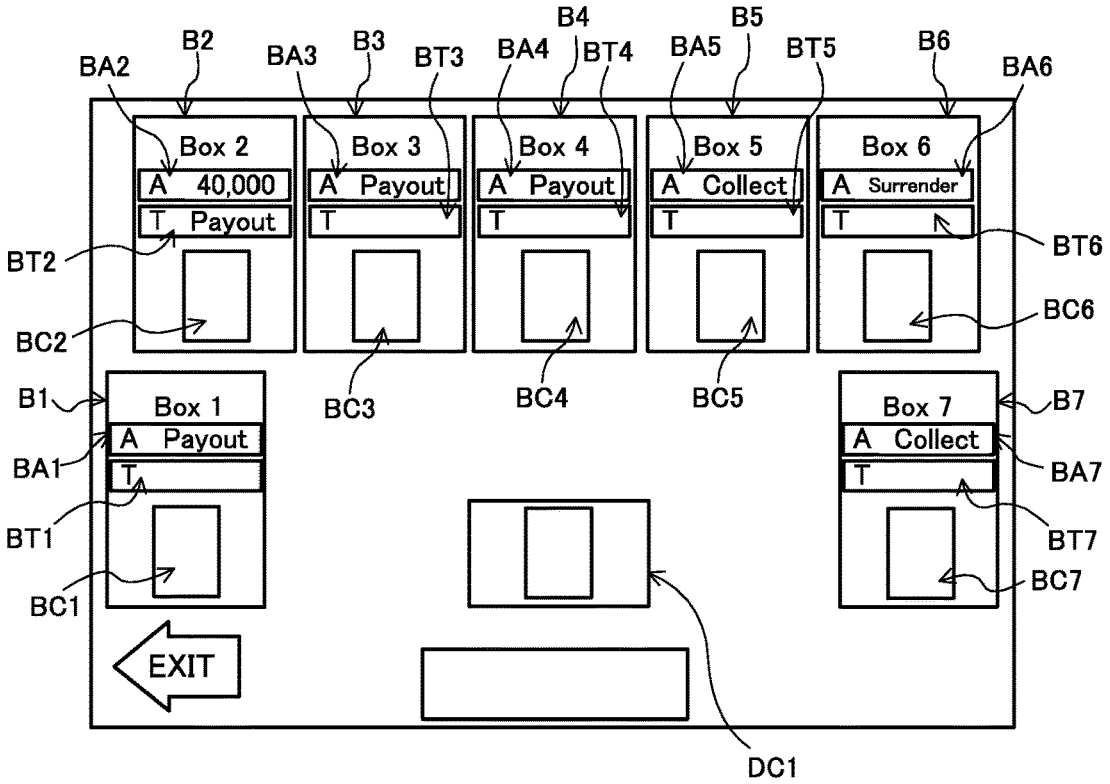

Since the players place the game chips in the Ante areas 42*a* to 48*a*, the players can indicate their intentions about the subsequent progress of the game among the following two options when the players tie with the dealer in the first comparison. In the embodiment, as illustrated in FIG. 6A and FIG. 6B, Box 2 and Box 6 applies to this case. One of the two options is referred to as "Surrender" that pays the half of the amount betted first to the dealer to fold. The other is referred to as "Go to War" that further bets the same amount as the amount betted first and competes (plays additional game) again. FIG. 7A illustrates a game progress pre-shift screen displayed after the dividends have been paid to the winning players and the game chips have been collected from the losing players until the tied players select either "Surrender" or "Go to War". By the way, since Box 2 having placed the game chips in the Tie area 43*b* as well as an Ante area 43*a* can receive the amount ten-times the dividend paid as described above, only the amount corresponding to the game chips placed in the Ante area 43*a* is targeted for the collection of the half of the bet amount by the dealer when the players select "Surrender" or the amount further betted by the players when the players select "Go to War".

The case in which the player corresponding to Box 6 selects "Surrender" will be described. The player (for example, the player corresponding to Box 6) who wants to select "Surrender" indicates his intention to select "Surrender" by adding the game chips corresponding to the half "$2,500" of the amount "$5,000" (FIG. 6A) betted in the first comparison to the Ante area 47*a*. As for the addition state of the game chips, information of the game chips added in the Ante area 47*a* is read by the second control unit 400 via the antennas 434 and the control section 450 and this chip information is transmitted from the second control unit 400 to the first control unit 200 via the network 500 and the management server 600. The first control unit 200 can decide that the player has selected "Surrender" based on the amount of the added game chips. At this time, the first control unit 200 displays the result of selection by the player on the dealer display 26. Specifically, as illustrated in a game chip increase and reduction checking screen in FIG. 7B, "Paid" is displayed in an Ante display area BA6 of the Box 6 display area B6 in which the amount corresponding to the game chips placed in the Ante area 47*a* has been displayed. Since the dealer can decide that the player of Box 6 has selected "Surrender" with reference to this screen, the dealer returns "$5,000", which has been first betted, among the game chips placed in the Ante area 47*a* of the bet area 47 corresponding to the player of Box 6 to the player and collects "$2,500", which has been added.

Due to this collection operation, no game chips are placed in the Ante area 47*a* of the bet area 47. This state change is transmitted to the first control unit 200 via the antenna modules 430, the second control unit 400, and the network 500. The first control unit 200 decides that "Surrender" by the player of Box 6 has been confirmed based on this state change and switches the display (Ante display area BA6 of the Box 6 display area B6) on the dealer display 26 to the Surrender confirmation screen illustrated in FIG. 8A.

In contrast, the case in which, for example, the player corresponding to Box 2 selects "Go to War" will be described. First, since ten times the amount betted in the Tie area 43*b* by the player of Box 2 is paid as the dividend as described above, the first control unit 200 displays "Payout" in a Tie display area BT2 of the Box 2 display area B2 corresponding to the Tie area 43*b* used by Box 2 of the dealer display 26 based on the result of the game as illustrated in an additional bet display screen in FIG. 8B. Then, this player indicates his intention to select "Go to War" by adding the game chips equal to the amount "$20,000" betted in the first comparison to the Ante area 43*a*. As for the addition state of the game chips, information of the game chips added in the Ante area 43*a* is read by the second control unit 400 via the antennas 434 and the control section 450 and this chip information is transmitted from the second control unit 400 to the first control unit 200 via the network 500 and the management server 600. The first control unit 200 can decide that the player has selected "Go to War" based on the amount of the added game chips. At this time, the first control unit 200 displays the result of selection by the player on the dealer display 26. Specifically, as illustrated in the additional bet display screen in FIG. 8B, for example, "$40,000", which is obtained by adding the same amount to the amount first betted, is displayed in an Ante display area BA2 of the Box 2 display area B2 of the dealer display 26 corresponding to the Ante area 43*a*. The dealer can decide that the player of Box 2 has selected "Go to War" with reference to this display.

Figure 9A:
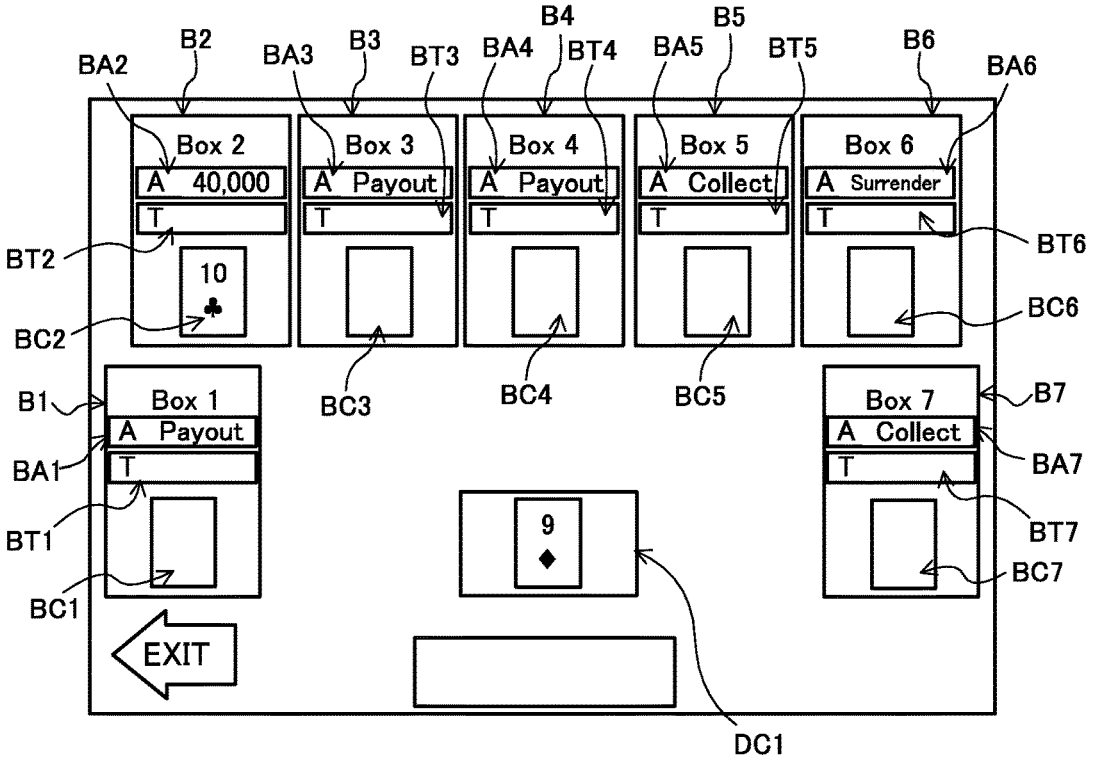
FIGS. 9A and 9B illustrate examples of images displayed on the dealer display.

After the additional bet by Box 2 is completed, the dealer takes new game cards from the card shoe 310, distributes the game cards to the player and the dealer, one for each, as described above, compete again, and compares these cards. Specifically, the dealer distributes the game cards to the bet area 43 and the dealer area 49. This comparison is referred to below as the second comparison. The first control unit 200 recognizes information (suit information and numerical information) of the cards distributed to Box 2 having shifted to "Go to War" at this time and the dealer based on identification information output from the card shoe 310 each time a game card is distributed and switches the display on the dealer display 26 to an additional game result screen as illustrated in FIG. 9A. The additional game result screen in FIG. 9A displays that the dealer has the game card of "9 of diamonds" and the player of Box 2 has the game card of "10 of clubs". Specifically, on the dealer display 26, an image representing the game card of "9 of diamonds" is displayed in the dealer card display area DC1 and an image representing the game card of "10 of clubs" is displayed in a card display area BC2 of the Box 2 display area B2. That is, the dealer display 26 displays information indicating that Box 2 has won against the dealer.

Figure 9B:
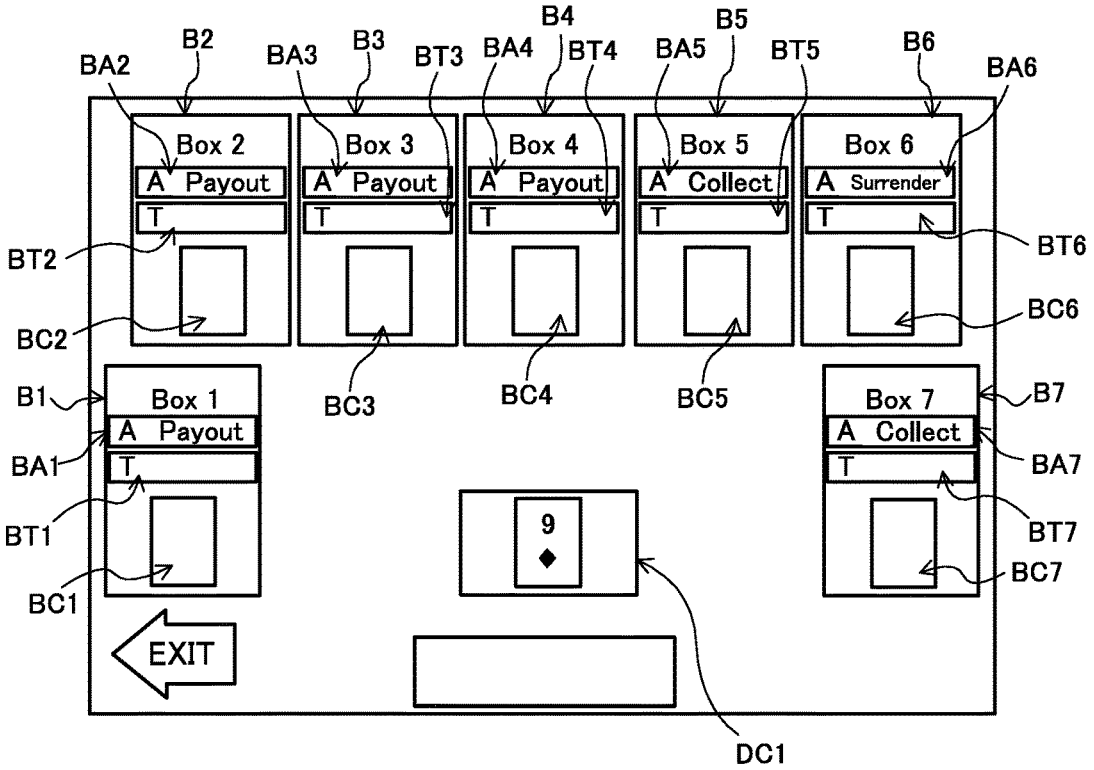
Figure 10:
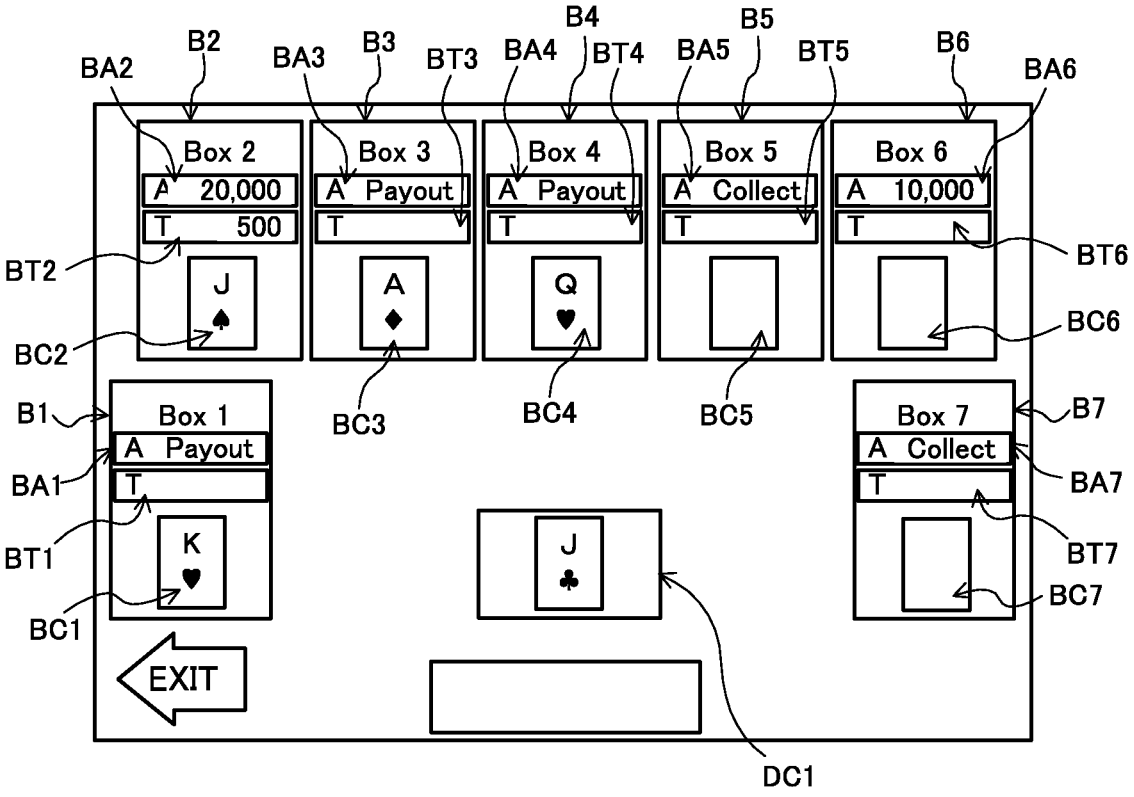
FIG. 10 illustrates examples of images displayed on the dealer display.

The first control unit 200 performs a switchover to an additional payout and collection screen illustrated in FIG. 9B 0.6 seconds after displaying the additional game result screen illustrated in FIG. 9A. Here, the dividend after win or lose is determined in the second comparison will be described. When the player loses, all of the game chips placed in the Ante areas 42*a* to 48*a* are collected as in the first comparison. In contrast, when the player wins, the dividend equal to the amount betted in the second comparison is paid to the player and the amount betted in the first comparison is returned to the player as is. In addition, when the player ties again, the dividend equal to the amount betted in the first comparison and the dividend equal to the amount betted in the second comparison are paid to the player and the game chips corresponding to the amounts betted in the first comparison and the second comparison are returned to the player. Accordingly, in the embodiment, the dividend equal to the amount betted by the player in the second comparison is paid to Box 2 and the amount betted in the first comparison is returned to the player as is.

The first control unit 200 transmits the game result (win, lose, or tie) of Box 2 to the management server 600. The management server 600 performs calculation and processing of payout or collection based on the game results received from the first control unit 200. On assumption that the dealer has performed this payout or collection correctly, the first control unit 200 receives, from the management server 600, the results of automatic calculation and processing by the management server 600 and displays the results on the dealer display 26. Specifically, in the embodiments, as in the additional payout and collection screen illustrated in FIG. 9B, "Payout" is displayed in the Ante display areas BA2 corresponding to the Ante areas 43*a* of Box 2. When payout or collection with respect to the amount corresponding to the game chips betted by the player in the second comparison is completed, the game is completed. After that, when the dealer performs a predetermined operation for specifying the completion of the game, the first control unit 200 returns the screen displayed on the dealer display 26 to the waiting screen in FIG. 5A from the additional payout and collection screen in FIG. 9B and shifts to a start state for a new game. Accordingly, the dealer can start a new game when the players bet game chips.

By the way, when the player of Box 6 selects "Go to War" instead of "Surrender", the player of Box 6 indicates his intention to select "Go to War" by adding the game chips corresponding to the same amount as in the first comparison in the Ante area 47*a* of the bet area 47 of the player. As for the addition state of the game chips, information of the game chips added in the Ante area 47*a* is read by the second control unit 400 via the antennas 434 and the control section 450 and this chip information is transmitted from the second control unit 400 to the first control unit 200 via the network 500 and the management server 600. The first control unit 200 can decide that the player has selected "Go to War" based on the amount of the added game chips. At this time, the first control unit 200 displays the result of selection by the player on the dealer display 26. Specifically, as illustrated in the additional bet display screen in FIG. 10, for example, "$10,000", which is obtained by adding the same amount to the amount first betted, is displayed in an Ante display area BA6 of the Box 6 display area B6 of the dealer display 26 corresponding to the Ante area 47*a*. The dealer can decide that the player of Box 6 has selected "Go to War"

with reference to this screen. After that, an additional game between the player and the dealer is performed following the game flow described above.

(Main Processing by Gaming Table Apparatus 100)

Next, main processing for executing the card game described above by the first control unit 200 will be described. As illustrated in FIG. 11A, the first control unit 200 starts the main processing by executing a program stored in the ROM 214 and then performs chip information read control processing of game chips in step SP101. In this chip information read control processing, the first control unit 200 instructs the second control unit 400 (antenna modules 430) to always read the chip information three times to reduce read error of the chip information. The management server 600 decides whether the chip information read via the antenna modules 430 and the second control unit 400 is an unregistered chip (that is, an error chip) based on the registered information thereof and the bet amount and the first control unit 200 obtains such information from the management server 600. Then, the first control unit 200 shifts the processing to step SP102 and decides whether the game chips placed in the bet areas 42 to 48 are error chips based on the chip information obtained in step SP101 above.

An affirmative result obtained in step SP102 denotes inclusion of an illegitimate game chip. In this case, the first control unit 200 shifts the processing to step SP103 and performs error processing. In this error processing, the first control unit 200 performs predetermined error display on the dealer display 26.

In contrast, a negative result obtained in step SP102 denotes that the game chips placed in the bet areas 42 to 48 are legitimate. In this case, the first control unit 200 shifts the processing from step SP102 to step SP104 and decides whether the dealer has touched the "No More Bet" area N1 on the dealer display 26.

A negative result (when the dealer does not touch the "No More Bet" area N1) obtained in step SP104 denotes that the player further performs an additional bet. Then, the first control unit 200 shifts the processing to step SP101 described above and executes the chip information read control processing again. That is, the first control unit 200 repeatedly performs the chip information read control processing until the dealer touches the "No More Bet" area N1.

In contrast, an affirmative result (when the dealer touches the "No More Bet" area N1) obtained in step SP104 denotes that the player has completed a bet. Then, the first control unit 200 shifts the processing from step SP104 to step SP105 and performs bet confirmation processing. In this bet confirmation processing, the first control unit 200 stores the confirmed bet amounts of the players as decision factors for deciding the game results.

Upon completion of the bet confirmation processing, the first control unit 200 shifts the processing to step SP106 and determines the win or lose (that is, game results) between the players and the dealer based on the bet amounts of the players confirmed in step SP105 above and the information of the game cards distributed to the players and the game card distributed to the dealer obtained via the antenna modules 430, the second control unit 400, the network 500, and the management server 600.

Then, the first control unit 200 shifts the processing to step SP107 and decides whether "Game End" (the end of the game) has been reached based on the game result in step SP106 above.

A negative result obtained in step SP107 denotes that the game has not ended even though the bet has been confirmed and the game result has been determined, that is, the dealer has tied with a player. In this case, the first control unit 200 shifts the processing to step SP120 and performs Tie processing, which will be described later.

In contrast, an affirmative result obtained in step SP107 denotes that the game has ended (that is, the dealer has not tied with the players) and the first control unit 200 shifts the processing to game chip collection and payout control processing in SP108. Then, the first control unit 200 calculates, in step SP108, the amounts corresponding to the game chips placed in the bet areas 42 to 48 based on the game result obtained in step SP106 above and the chip information obtained in step SP101 and displays the result on the dealer display 26. The first control unit 200 shifts the processing to step SP109 when the processing in step SP108 ends and reads information (character information illustrated in FIG. 5 to FIG. 10 and display colors of Box 1 to Box 6) about the destinations (such as "Go to War", "Surrender", win, and lose) to which the game proceeds to determined for each of the players from the ROM 214, and displays the read information on the dealer display 26. Then, the first control unit 200 returns to step SP101 after the processing in step SP109 to perform the main processing described above repeatedly.

(Tie Processing by Gaming Table Apparatus 100)

The Tie processing described above will be described. As illustrated in FIG. 11B, the first control unit 200 starts the Tie processing by executing a program stored in the ROM 214 and then waits for an additional bet of the players in step SP121. Then, the first control unit 200 shifts the processing from step SP121 to step SP122 and decides whether additional bets have been performed by the players.

A negative result obtained in step SP122 denotes that the players have not newly add game chips in the bet areas 42 to 48. In this case, the first control unit 200 shifts the processing to step SP121 above and waits for the players to perform additional bets. By the way, whether game chips have been newly added to the bet areas 42 to 48 can be decided based on changes in information sent from the game chips that is received via the antenna modules 430 individually disposed in the bet areas 42 to 48. Specifically, since the second control unit 400 stores, in the RAM 216, information (information of game chips decided by the management server 600 as legitimate game chips) of game chips received via the corresponding antenna modules 430 in the bet areas 42 to 48, the second control unit 400 can decide that additional bets have been performed when obtaining the information of game chips that is not stored before by comparing the stored information with newly obtained information.

In contrast, an affirmative result obtained in step SP122 denotes that the players have newly placed game chips in the bet areas 42 to 48. In this case, the first control unit 200 shifts the processing to step SP123 and performs chip information read control processing of the game chips newly placed in the bet areas 42 to 48 (that is, the game chips additionally betted). In this chip information read control processing, the first control unit 200 instructs the second control unit 400 (antenna modules 430) to always read the chip information three times to reduce read error of the chip information. The management server 600 decides whether the chip information read via the antenna modules 430 and the second control unit 400 is an unregistered chip (that is, an error chip) based on the registered information thereof and the bet amount and the first control unit 200 obtains such information from the management server 600. Then, the first control unit 200 shifts the processing to step SP124 and decides whether the game chips additionally betted in any of the bet areas 42 to 48 are error chips based on the chip information obtained in step SP123 above.

An affirmative result obtained in step SP124 denotes inclusion of an illegitimate game chip. In this case, the first control unit 200 shifts the processing to step SP125 and performs error processing. In this error processing, the first control unit 200 performs predetermined error display on the dealer display 26.

In contrast, a negative result obtained in step SP124 denotes that the game chips additionally betted in any of the bet areas 42 to 48 are legitimate. In this case, the first control unit 200 shifts the processing from step SP124 to step SP126 and decides whether the bet amount additionally betted meets the conditions for shifting to "Go to War", which is an additional game after a tie.

Specifically, the first control unit 200 sequentially stores the bet amounts of the game chips betted as the game proceeds for each of the bet areas 42 to 48 in the RAM 216. Accordingly, the bet amount additionally betted can be compared with the previous bet amount in the game in the bet area (one of the bet areas 42 to 48) in which an additional bet has been performed. Then, the first control unit 200 decides whether the tied player (any of the bet areas 42 to 48) has additionally betted. That is, the first control unit 200 decides, in step SP126, whether an additional bet amount X is equal to a confirmed bet amount A confirmed in the same bet area (one of the bet areas 42 to 48) confirmed in step SP105 above (FIG. 11A).

A negative result obtained in step SP126 denotes that the additional bet amount X of the player is not equal to the confirmed bet amount A confirmed in step SP105. In this case, the first control unit 200 shifts the processing from step SP126 to step SP127. Then, the first control unit 200 decides, in step SP127, whether the additional bet amount of the player is the half of the confirmed bet amount A confirmed in step SP105. Since a negative result obtained here denotes that the bet amount of the player is larger or smaller than the half of the confirmed bet amount A confirmed in step SP105, the first control unit 200 shifts the processing to step SP123 and performs chip information read control processing again. That is, since the tied player is expected to perform further additional bets, the first control unit 200 waits for further additional bets.

In contrast, an affirmative result obtained in step SP127 denotes that the bet amount of the player is equal to the half of the confirmed bet amount A confirmed in step SP105. In this case, the first control unit 200 shifts the processing to step SP128 and performs "Surrender" control processing for executing "Surrender" described above with reference to FIG. 8A.

In contrast, an affirmative result obtained in step SP126 denotes that an additional bet amount (X) of the player is the same as the bet amount (A) confirmed in step SP105. In this case, the first control unit 200 shifts the processing from step SP126 to step SP129, shifts to the additional game described above with reference to FIG. 9A and FIG. 9B, and performs "Go to War" control processing.

When the "Surrender" control processing or the "Go to War" control processing is completed, the first control unit 200 ends the Tie processing and returns to the main processing illustrated in FIG. 11A.

In the processing procedure described above, first processing that determines the destination to which the game proceeds for each players based on the identification information detected by the detecting device and the monetary value read by the reading unit corresponds to "bet confirmation" processing (step SP105) and the "game result determination" processing (step SP106), second processing that determines the destination to which the game proceeds for each of the players when the monetary value read by the reading unit changes corresponds to the "Tie processing" (step SP120), and third processing that reads information about the determined destination to which the game proceeds from the memory and displays the read information on the display corresponds to "display" processing (step SP109).

As described above, in the gaming table apparatus system 10 according to the embodiment, the first control unit 200 displays information (FIG. 5 to FIG. 10) that supports the progress of the game proceeded by the dealer on the dealer display 26.

This display switches to the display of the screen illustrated in FIG. 5 to FIG. 10 according to the progress of the game performed by the dealer. The first control unit 200 decides the trigger for switching (that is, the progress status of the game) based on the identification information of a game card output from the detection unit 320 of the card shoe 310 to the first control unit 200 via the control board 330 each time the card is taken from the card shoe 310 (that is, each time the card is distributed to each of the player or the dealer). That is, the first control unit 200 decides win or lose and the like of the game and determines (selects) the subsequent progress of the game according to the contents of the game cards distributed to the players and the dealer and displays information that depends on the determination on the dealer display 26.

In the first control unit 200, the timing for progressing the game that cannot be determined only by the identification information of a game card from the card shoe 310 is the timing at which the player selects whether the processing shifts to "Go to War" or "Surrender" in the "Tie processing" (FIG. 11). As for this selection, the player (or the dealer) conventionally specifies desired selection by operating a predetermined selection switch or the like. In the embodiment, however, by focusing attention on the amount of game chips additionally betted by the player in such selection timing represents the selection, the amount of the additional bet by the player that is necessarily generated during the progress of the game is automatically detected by the first control unit 200 via the antenna modules 430, the selection by the player is recognized based on this detection result, and the screen (for example, FIG. 7B to FIG. 10) that depends on the selection is displayed on the dealer display 26. This can prevent intervention of a complicated switch operation by the player (or the dealer) such as an operation of a predetermined selection switch that is other than a manual operation necessary for the progress of the game such as a bet operation. This can prevent the progress of the game from being interrupted by the switch operation, thereby making the progress of the game more smoothly. In addition, the progress time of the game can be shortened.

In addition, since the selection by the player is decided based on a bet operation as in the above embodiment, even when the progress (game sequence) of the game is recorded in the RAM 216 or the like of the first control unit 200, such data can be collected without intervention of the dealer operation.

Although the above embodiment describes the case in which an RFID tag is provided in each of game chips and chip information is obtained by the management server 600 via the antenna modules 430, the invention is not limited to this example, the chip information (for example, information of the amounts of chips betted in the bet areas 42 to 48) of game chips may be obtained by the dealer manually inputting via a predetermined input unit.

In addition, although the first control unit 200 decides that the player (for example, Box 6 illustrated in FIG. 7A) has selected "Surrender" based on the addition of the half "$2,500" of the amount "$5,000" first betted by the "Tied" player to the bet area 47 in the above embodiment, the invention is not limited to this example and the first control unit 200 may decide that the player has selected "Surrender" when the half of the amount "$5,000" first betted is returned to the player and the half of the remaining amount is collected. In this case, the first control unit 200 may decide that the player has selected "Surrender" by determining that the half of the amount first betted has been collected when the game chips of "$5,000" are once collected and then the half "$2,500" of the amount is placed in the bet area 47.

In addition, although the case in which the invention is applied to a game called as Casino War is described in the above embodiment, the game content is not limited to this example and the invention is applicable to various games for which the progress of the game changes as the bet amount increases or reduces.

PARTS LIST

10 gaming table apparatus system
20 gaming table
100 gaming table apparatus
200 first control unit
300 game result reporting display
310 card shoe
400 second control unit
430 antenna module

What is claimed is:

1. A gaming table apparatus for a card game having a plurality of successive rounds and a plurality of possible directions in which play during the card game may proceed based on a value of game media bet in a successive round being equal to or decreased relative to a value of game media bet in a previous round, the gaming table comprising:

a plurality of bet areas adapted to receive a game player bet in the card game, each of the plurality of bet areas including indicia corresponding to a bet sub-area, each of the bet areas in communication with a reading unit capable of automatically determining a value corresponding to gaming media placed in one or more of the plurality of bet areas during the card game;

a second control unit including a central processing unit (CPU) and a non-transitory computer readable storage device that receives and stores information pertaining to the value of the gaming media placed in the one or more of the plurality of bet areas during each round of the card game;

a card shoe adapted to dispense one or more cards during the card game;

a detecting device that detects identification information pertaining to the cards dispensed via the card shoe during the card game and outputs the detected identification information;

a first control unit including a central processing unit (CPU) and a non-transitory computer readable storage device that stores and transmits information corresponding to one of the plurality of possible directions in which play of the card game may proceed based on the value of gaming media placed in the one or more of the plurality of bet areas during a first round of the card game;

a display device that displays the transmitted information corresponding to one of the plurality of possible directions in which play of the card game may proceed;

wherein the first control unit is in electronic communication with the second control unit via a communications network and is programmed to perform:

first processing that automatically determines a first one of the plurality of possible directions in which play of the card game may proceed for each of the plurality of bet areas based on the identification information detected by the detecting device and a first value of a first amount of gaming media placed in one or more of the plurality of bet areas during play of a first round of the card game as determined by the reading unit, and received by the second control unit, based on a result of the first round, second processing that automatically determines a second subsequent one of the plurality of possible directions in which play of the card game may proceed for each of the plurality of bet areas when a subsequent second value of a second amount of gaming media placed in the one or more of the plurality of bet areas during play of the card game as determined by the reading unit and received by the second control unit is equal to or decreased relative to the first value of the first amount of gaming media placed in the one or more of the plurality of bet areas during play of the first round of the card game according to a predetermined ratio of the first value relative to the second value, and third processing that obtains the information about the determined one of the plurality of possible directions in which play of the card game may proceed from the non-transitory computer readable storage device of the first control unit and displays the information on the display.

2. The gaming table apparatus according to claim 1, wherein the third processing includes processing that changes a display color of the information displayed on the display device according to the determined one of the plurality of possible directions to which the card game proceeds, the display color being assigned for each of the bet areas.

3. The gaming table apparatus according to claim 1, wherein the third processing includes processing that reads character information pertaining to the determined one of the plurality of possible directions to which the unit card game proceeds from the non-transitory computer readable storage device of the first control unit according to the subsequent second amount of gaming media bet at the bet areas and displays the read character information on the display.

4. The gaming table apparatus according to claim 1, wherein each of the plurality of bet areas includes an antenna module capable of receiving a radio signal transmitted from a game chip.

5. The gaming table apparatus according to claim 1, further comprising a dealer area including an antenna module capable of receiving a radio signal transmitted from a game chip.

6. The gaming table apparatus according to claim 1, wherein the card shoe comprises a light emitting unit capable of emitting infrared light so as to illuminate the cards, and a detector capable of receiving light reflected by the cards.

7. The gaming table apparatus according to claim 1, wherein the first processing corresponds to operations related to confirmation of an initial bet and a game result determination.

8. The gaming table apparatus according to claim 1, wherein the second processing corresponds to an operation related to confirmation of a subsequent bet as a result of a tie and game result determination.

9. The gaming table apparatus according to claim 7, wherein the third processing corresponds to an operation related to displaying the initial bet and the game result determination according to a color.

10. The gaming table apparatus according to claim 8, wherein the third processing corresponds to an operation related to displaying the subsequent bet and the game result determination according to a color.

11. The gaming table apparatus according to claim 1, wherein the sub-areas include an ante sub-area and a tie sub-area.

12. The gaming table apparatus according to claim 1 including an antenna configured to receive a signal transmitted from gaming media placed in one or more of the plurality of bet areas during the card game.

13. The gaming table apparatus of claim 1, wherein the result of the first round is one of a win, a loss, or a tie.

14. The gaming table apparatus of claim 13, wherein when the result of the first round is a tie, when the second amount of gaming media placed in one or more of the plurality of bet areas during play of the second round of the card game as determined by the reading unit and received by the second control unit is equal to the first value of the first amount of gaming media placed in the one or more of the plurality of bet areas during play of the first round of the card game, a subsequent round of the card game to determine the winner of the tie result is played.

15. The gaming table apparatus of claim 13, wherein when the result of the first round is a tie, when the second amount of gaming media placed in one or more of the plurality of bet areas during play of the second round of the card game as determined by the reading unit and received by the second control unit is less than the first value of the first amount of gaming media placed in the one or more of the plurality of bet areas during play of the first round of the card game according to a predetermined ratio of the first value relative to the second value, a subsequent round of the card game to determine the winner of the tie result is not played.

16. The gaming table apparatus of claim 13, wherein the card game is war.

* * * * *